US006989062B2

(12) United States Patent
Zhou et al.

(10) Patent No.: US 6,989,062 B2
(45) Date of Patent: Jan. 24, 2006

(54) HEAT TREATMENT OF IRON-BASED COMPONENTS

(75) Inventors: Ye Zhou, Höganäs (SE); Per-Olof Larsson, Helsingborg (SE); Henrik Andersson, Helsingborg (SE); Lars Hultman, Viken (SE)

(73) Assignee: Höganäs AB, Höganäs (SE)

( * ) Notice: Subject to any disclaimer, the term of this patent is extended or adjusted under 35 U.S.C. 154(b) by 335 days.

(21) Appl. No.: 10/366,616

(22) Filed: Feb. 14, 2003

(65) Prior Publication Data

US 2004/0079452 A1 Apr. 29, 2004

(30) Foreign Application Priority Data

Oct. 25, 2002 (SE) ..... 0203168

(51) Int. Cl.
*H01F 1/03* (2006.01)

(52) U.S. Cl. ..... 148/104; 148/122; 419/10; 419/29; 419/35; 419/37; 419/64

(58) Field of Classification Search ..... 148/104, 148/122; 419/10, 29, 35, 37, 64
See application file for complete search history.

(56) References Cited

U.S. PATENT DOCUMENTS 5,122,255 A * 6/1992 Noda et al. ..... 204/425
5,754,936 A * 5/1998 Jansson ..... 419/10
5,798,177 A * 8/1998 Jansson ..... 428/403
6,419,877 B1 * 7/2002 Elgelid et al. ..... 419/35
6,652,458 B2 * 11/2003 Blazey et al. ..... 600/300
2001/0019771 A1 * 9/2001 Elgelid et al. ..... 428/403
2002/0135089 A1 9/2002 Koch et al.
2004/0191519 A1 * 9/2004 Kejzelman et al. ..... 428/407

FOREIGN PATENT DOCUMENTS

| | | |
|---|---|---|
| EP | 0 765 199 B1 * | 4/1997 |
| WO | WO 95/29490 | 11/1995 |
| WO | WO 99/03622 | 1/1999 |
| WO | WO 02/058865 | 8/2002 |

OTHER PUBLICATIONS

AGA Gashandbok, vol., 1982, Kersti Ahlberg et al., "*AGA Gashandbok*", p. 252 to p. 253, förlag: Almqvist & Wiksell Tryckeri AB.

* cited by examiner

*Primary Examiner*—John P. Sheehan
(74) *Attorney, Agent, or Firm*—Buchanan Ingersoll PC

(57) ABSTRACT

The present invention concerns a method of improving the properties of powder metallurgically produced SMC compacted body consisting of a soft magnetic material of insulated powder particles and a lubricant, to a stress relieving heat treatment in a furnace until the component has reached a temperature of at least 400° C. in an oxygen containing atmosphere having a CO content is less than 0.25% by volume.

18 Claims, 5 Drawing Sheets

Initial permability as a function of the frequency and at different CO- contents Core losses as a function of the frequency at an induction of 1 Tesla Component temperature as a function of dwell time at different oven temperatures Initial permability as a function of the frequency, heat treated at different temperatures and dwell times.

500° C, 30 min

500° C 55 min

600° C, 28 min

Apperance of components heat treated at 500° C, 30 min; 500° C 55 min; and 600° C, 28 min.

HEAT TREATMENT OF IRON-BASED COMPONENTS

The present invention concerns soft magnetic composite components. Particularly the invention concerns a method of improving the properties of such components by controlling the conditions during heat treatment of the soft magnetic composite components.

Soft magnetic materials are used for applications, such as core materials in inductors, stators, rotors, electrical machines, actuators and sensors. Traditionally soft magnetic cores, such as rotors and stators in electric machines are made of stacked steel laminates. Soft Magnetic Composite, SMC, materials are based on soft magnetic particles, usually iron-based, with an electrically insulating coating on each particle. SMC parts are made by compacting insulated particles together with lubricants, and/or binder using the traditionally powder metallurgy process. By using such powder metallurgically produced materials a higher degree of freedom in the design of the SMC component is permitted than by using the steel laminates as the SMC material can carry a three dimensional magnetic flux and as three dimensional shapes can be obtained by the compaction process.

However, compaction of the insulated powder to a SMC component induced stresses, especially when the component is compressed to higher densities, which has a negative influence of magnetic properties, such as permeability and hysteresis losses. Heat treatment will have a stress relieving effect and will hence partially restore the permeability and hysteresis losses. The heat treatment must, however, not result in the deterioration of the insulating layer/coating as then metal to metal contact occurs and the eddy current losses increase. Additionally, in order to avoid cold welding between the iron particles and to maintain the continuous coating during the pressing operations, it is recommended to add lubricants the insulated powder.

A problem encountered when heat treating the powder metallurgically produced SMC components is that the magnetic properties tend to vary depending on the conditions of the heat treatment and the size of the component. This is a particularly the case in industrial production. Another problem, which has also been observed in industrial production, is that the component surface is stained by residues of incompletely decomposed lubricants.

It has now surprisingly been found that powder metallurgically produced SMC components having a high quality surface without stains can be obtained by subjecting a compacted body consisting of a soft magnetic material of insulated powder particles and a lubricant, to a stress relieving heat treatment in a furnace until the component has reached a temperature of at least 400° C. in an atmosphere having a CO content less than 0.25% by volume. Preferably, heat treatment is performed until the component has reached a temperature between 450 and 650° C., and most preferably between 450 and 550° C. The heat treatment is performed in an oxygen containing atmosphere, preferably in air.

According to a preferred embodiment the method may be performed by measuring the concentration of CO in at least one point of the heat treatment furnace during the whole heat treatment cycle, and that the measured value of the CO concentration is used for controlling the furnace atmosphere. The CO content may thus be adjusted by controlling the air flow through the furnace.

Furthermore, the furnace temperature may be set at a value above the maximum intended component temperature, The temperature of the SMC component is then measured and the heat treating cycle is terminated when the temperature of the component reaches the intended component temperature.

The invention will be further illustrated by following example:

EXAMPLE 1

Magnetic rings with an inner diameter of 45 mm, an outer diameter of 55 mm and a height of 5 mm were produced by compaction of a pure iron based powder with a continuous coating, Somaloy 500™, together with 0.5% of the lubricant Kenolube™. The compaction pressure was 800 MPa and a green density of 7.35 g/cm$^3$ was obtained. The rings were heat treated in air at 500° C. in a continuous production furnace at different CO concentrations obtained by adjusting the flow of air through the furnace.

The initial permeability was measured as a function of the frequency. The ability of the obtained SMC component to maintain the initial permeability at higher frequency is referred to as frequency stability.

FIG. 1 shows that the frequency stability is higher for the material heat treated at lower concentrations of CO. For a concentration of 0.25% CO, and below, acceptable values for the frequency stability were obtained.

The total losses were also measured and FIG. 2 shows that total loss for material heat treated at three different CO-concentrations. FIG. 2 shows a decrease in total losses when the CO-concentration is decreased.

EXAMPLE 2

Cylindrical SMC components with the diameter of 80 mm, height of 30 mm and weight of approximately 1 kg were produced with the same iron-based powder mixture as in example 1 and the heat treatment was performed at two different furnace temperatures, 500 and 600° C., respectively. For the components heat treated at 500° C. the heat treatment was terminated after 30 minutes and 55 minutes, respectively. For the components heat treated at 600° C. the process was terminated after 28 minutes.

The frequency stability of the components heat treated at an furnace temperature of 600 C, 28 min and 500 C, 50 min is acceptable and as the permeability is higher below 80 kHz for these components compared to components heat treated at 500 C, 30 min the method of utilising a higher furnace temperature and a shorter dwell time is preferable.

Figure 1:
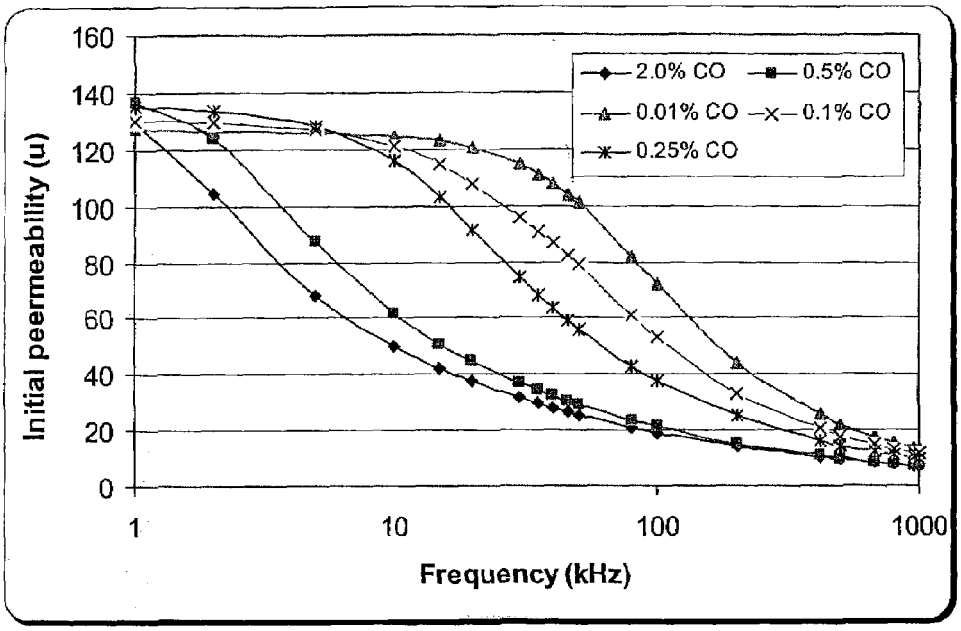
Figure 2:
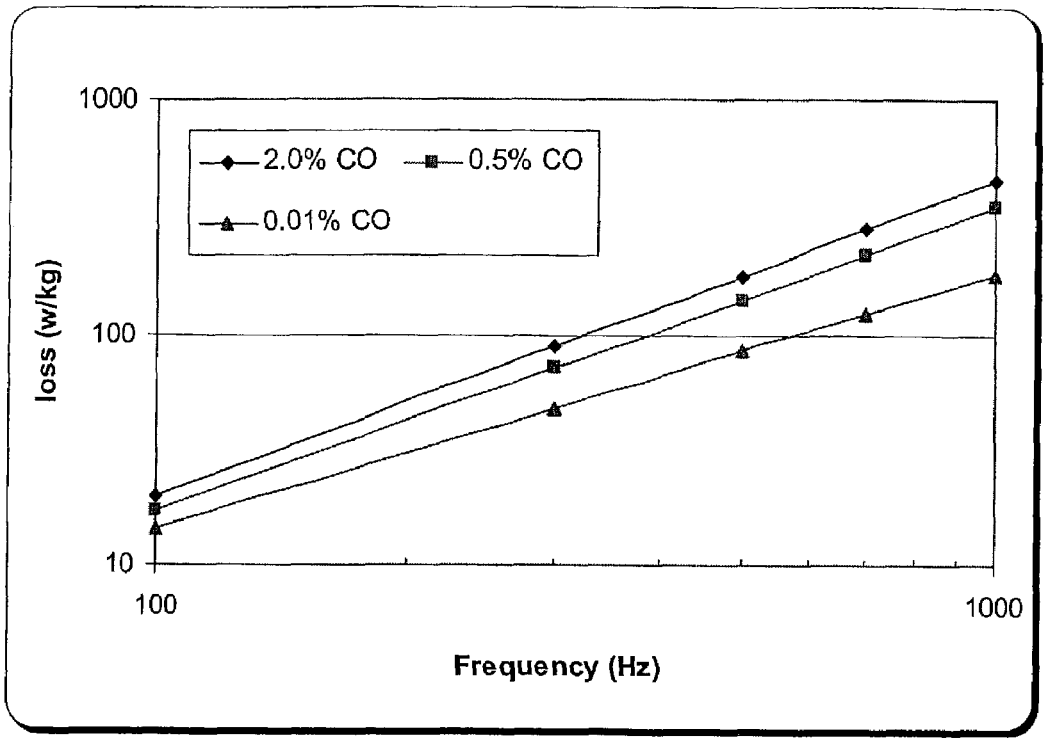
Figure 3:
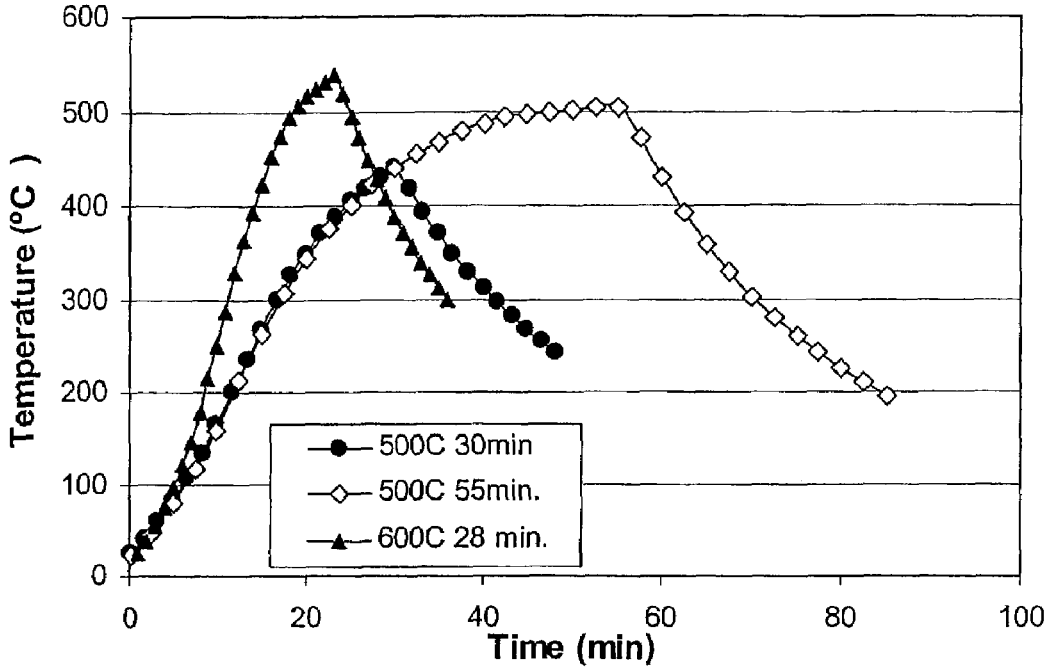
FIG. 3 shows the temperature profile of the components and it can be concluded that the temperature of the component heat treated at an furnace temperature of 600° C. reached 550° C. after 28 minutes.
Figure 4:
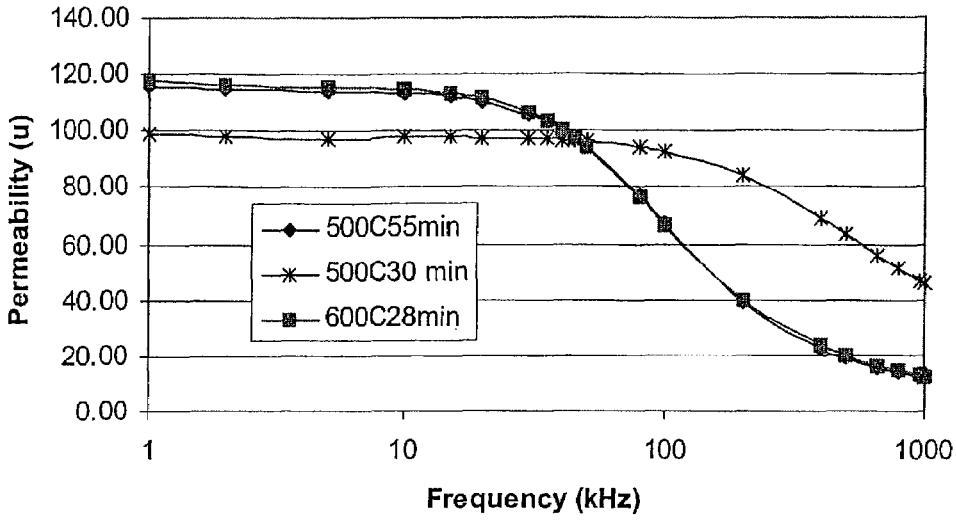
FIG. 4 shows that the same permeability is obtained for components heat treated at 500° C., 55 minutes and for components heat treated at 600° C., 28 minutes, whereas components heat treated at 500° C. for 30 minutes have a lower permeability up to the frequency of about 80 kHz.
Figure 5:
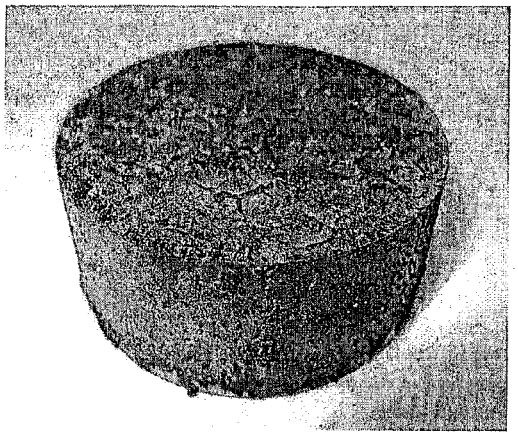
Figure 5:
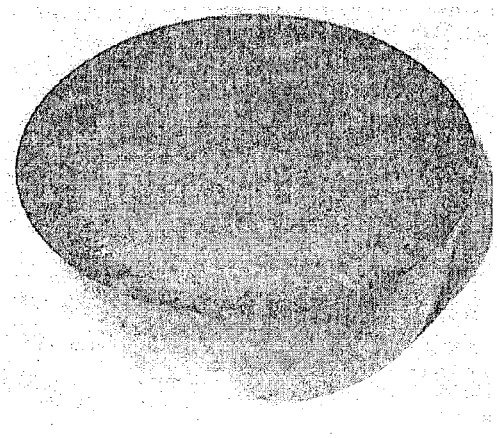
Figure 5:
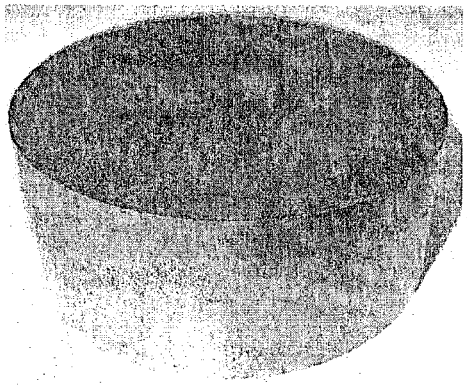

The surfaces of the components were visually evaluated with respect to surface finish. FIG. 5 shows that the component heat treated at 600° C. and 28 minutes has a better surface finish compared with the components heat treated at 500° C. The surface finish of the component heat treated at 500° C., 50 min. was acceptable and much better than the surface finish of the component heat treated at 500° C., 28 min. but less shiny compared with the component heat treated at 600° C., 28 min. An increased productivity can thus be obtained by using a higher heat treating temperature and a lower dwell time without deteriorating the magnetic permeability. A better surface finish can also be obtained.

What is claimed is:

1. A method for improving the properties of powder metallurgically produced SMC components by subjecting a compacted body consisting of a soft magnetic material of insulated powder particles and a lubricant, to a stress relieving heat treatment in a furnace until the component has reached a temperature of at least 400° C. in an oxygen containing atmosphere having a CO content less than 0.25% by volume wherein the concentration of CO is measured in at least one point of the heat treatment furnace during the whole heat treatment cycle, and that the measured value of the CO concentration is used for controlling the furnace atmosphere.

2. A method according to claim 1, wherein the temperature of the heat treatment is between 450 and 650° C.

3. A method according to claim 1, wherein the heat treatment is performed in air.

4. A method according to claim 1, wherein the CO content is adjusted by controlling the air flow through the furnace.

5. A method according to claim 1, wherein the furnace temperature is set at a value above the maximum intended component temperature, that the temperature of the SMC compound is measured and that the heat treating cycle is terminated when the temperature of the component reaches the intended component temperature.

6. A method according to claim 1, wherein the temperature of the heat treatment is between 450 and 550° C.

7. A method according to claim 2, wherein the heat treatment is performed in air.

8. A method according to claim 6, wherein the heat treatment is performed in air.

9. A method according to claim 2, wherein the CO content is adjusted by controlling the air flow through the furnace.

10. A method according to claim 3, wherein the CO content is adjusted by controlling the air flow through the furnace.

11. A method according to claim 1, wherein the CO content is adjusted by controlling the air flow through the furnace.

12. A method according to claim 6, wherein the CO content is adjusted by controlling the air flow through the furnace.

13. A method according to claim 2, wherein the furnace temperature is set at a value above the maximum intended component temperature, that the temperature of the SMC compound is measured and that the heat treating cycle is terminated when the temperature of the component reaches the intended component temperature.

14. A method according to claim 3, wherein the furnace temperature is set at a value above the maximum intended component temperature, that the temperature of the SMC compound is measured and that the heat treating cycle is terminated when the temperature of the component reaches the intended component temperature.

15. A method according to claim 1, wherein the furnace temperature is set at a value above the maximum intended component temperature, that the temperature of the SMC compound is measured and that the heat treating cycle is terminated when the temperature of the component reaches the intended component temperature.

16. A method according to claim 4, wherein the furnace temperature is set at a value above the maximum intended component temperature, that the temperature of the SMC compound is measured and that the heat treating cycle is terminated when the temperature of the component reaches the intended component temperature.

17. A method according to claim 5, wherein the furnace temperature is set at a value above the maximum intended component temperature, that the temperature of the SMC compound is measured and that the heat treating cycle is terminated when the temperature of the component reaches the intended component temperature.

18. A method according to claim 6, wherein the furnace temperature is set at a value above the maximum intended component temperature, that the temperature of the SMC compound is measured and that the heat treating cycle is terminated when the temperature of the component reaches the intended component temperature.

* * * * *